US009810470B2

(12) United States Patent
Li et al.

(10) Patent No.: US 9,810,470 B2
(45) Date of Patent: Nov. 7, 2017

(54) MANUAL ICE MAKER AND REFRIGERATOR COMPRISING WITH THE SAME

(75) Inventors: Lingyun Li, Hefei (CN); Jun Yao, Hefei (CN); Dongxian Liu, Hefei (CN)

(73) Assignees: Hefei Midea Refrigerator Co., Ltd., Hefei (CN); Hefei Hualing Co., Ltd., Hefei (CN)

( * ) Notice: Subject to any disclaimer, the term of this patent is extended or adjusted under 35 U.S.C. 154(b) by 199 days.

(21) Appl. No.: 14/007,924

(22) PCT Filed: May 5, 2011

(86) PCT No.: PCT/CN2011/073708

§ 371 (c)(1),
(2), (4) Date: Sep. 26, 2013

(87) PCT Pub. No.: WO2012/149691

PCT Pub. Date: Nov. 8, 2012

(65) Prior Publication Data

US 2014/0013791 A1 Jan. 16, 2014

(51) Int. Cl.
*F25C 5/14* (2006.01)
*F25C 1/00* (2006.01)
(Continued)

(52) U.S. Cl.
CPC ..... *F25C 1/00* (2013.01); *F25C 5/06* (2013.01); *F25C 1/10* (2013.01); *F25C 5/005* (2013.01);
(Continued)

(58) Field of Classification Search
CPC ..... F25C 1/10; F25C 2700/06; F25C 2700/2305; F25C 2700/022;
(Continued)

(56) References Cited

U.S. PATENT DOCUMENTS

2007/0283714 A1* 12/2007 Yoon et al. ..... 62/340
2008/0006048 A1* 1/2008 Yoon et al. ..... 62/345
(Continued)

FOREIGN PATENT DOCUMENTS

CN 1337557 2/2002
CN 1102231 2/2003
(Continued)

OTHER PUBLICATIONS

WO2008/020723, Kang et al., Feb. 21, 2008.*
WO2008/030020, Kim et al., Mar. 13, 2008.*
PCT/CN2011/073708, English Translation of the International Search Report mailed Feb. 23, 2012, 6 pages.
European Patent Application No. 11864866.6 Extended Search and Opinion dated May 8, 2015, 6 pages.

*Primary Examiner* — David Teitelbaum
(74) *Attorney, Agent, or Firm* — Lathrop Gage LLP

(57) ABSTRACT

A manual ice maker and a refrigerator comprising the same are provided. The manual ice maker comprises: an ice making body being a frame formed with an opening, and provided with a first positioning hole in a front wall thereof, a second positioning hole in a rear wall thereof and a first limiting protrusion on an inner surface of the rear wall thereof; an ice making tray provided with a first shaft at a front end thereof and a second shaft at a rear end thereof, the first shaft rotatably supported in and extended out of the first positioning hole, the second shaft rotatably supported in the second positioning hole; and an ice removing assembly. The ice removing assembly comprises: a twisting member provided with a gear; and a press member movable between a first position and a second position in a vertical direction to drive the gear to rotate.

14 Claims, 5 Drawing Sheets

(51) Int. Cl.

| | |
|---|---|
| ***F25C 5/06*** | (2006.01) |
| *F25C 5/00* | (2006.01) |
| *F25C 5/02* | (2006.01) |
| *F25C 1/10* | (2006.01) |

(52) U.S. Cl.
CPC ..... *F25C 5/02* (2013.01); *F25C 2305/022* (2013.01); *F25C 2400/10* (2013.01); *F25C 2700/06* (2013.01)

(58) Field of Classification Search
CPC ..... F25C 2305/022; F25C 1/00; F25C 5/02; F25C 5/005
See application file for complete search history.

(56) References Cited

U.S. PATENT DOCUMENTS

| | | | | |
|---|---|---|---|---|
| 2008/0209936 | A1* | 9/2008 | Kim | 62/340 |
| 2009/0019880 | A1* | 1/2009 | Lee et al. | 62/345 |
| 2010/0126203 | A1 | 5/2010 | Kim et al. | |

FOREIGN PATENT DOCUMENTS

| | | | |
|---|---|---|---|
| CN | 101451782 | | 6/2009 |
| CN | 101523137 | | 9/2009 |
| CN | 201503177 | | 6/2010 |
| DE | 102008063200 | A1 | 7/2009 |
| WO | 2008/020723 | A1 | 2/2008 |
| WO | 2009057891 | | 5/2009 |
| WO | 2009/078583 | A1 | 6/2009 |

* cited by examiner

MANUAL ICE MAKER AND REFRIGERATOR COMPRISING WITH THE SAME

FIELD

The present disclosure relates to a household appliance designing and manufacturing field, and more particularly relates to a manual ice maker and a refrigerator comprising the same.

BACKGROUND

FIG. 1 is a schematic view of a conventional manual ice maker. As shown in FIG. 1, a refrigerator comprises a refrigerating chamber 100' and a freezing chamber 200'. An ice maker 300' is disposed in the freezing chamber 200'. The ice maker 300' comprises an ice storage box 310', a knob 320' and an ice making tray (not shown). Each end of the ice making tray is provided with a connecting shaft, and the ice making tray is fixed on a support thereof via connecting holes in the support. The knob 320' is hinged with the support of the ice making tray. By rotating the knob 320', the ice making tray is driven to deform, and thus the ice formed in the ice making tray is pressed to remove from the ice making tray and drop into the ice storage box 310'. Then, a user can take the ice by pulling out the ice storage box 310'.

For the conventional ice maker, when the user wants to remove the ice from the ice making tray, he/she needs to twist the knob connected with the ice making tray to make the ice making tray deformed. However, the knob is twisted only when the user applies a great force to the knob, especially in a situation when the ice making tray is frozen. Therefore, it is inconvenient for the user to use the conventional manual ice maker.

SUMMARY

The present application aims to overcome at least one of the above problems, especially the problem of inconvenient twisting of the knob.

For this, according to a first aspect of the present disclosure, a manual ice maker is provided. The manual ice maker comprises: an ice making body being a frame formed with an opening, and provided with a first positioning hole in a front wall thereof, a second positioning hole in a rear wall thereof and a first limiting protrusion on an inner surface of the rear wall thereof; an ice making tray provided with a first shaft at a front end thereof and a second shaft at a rear end thereof, in which the first shaft is rotatably supported in and extended out of the first positioning hole, and the second shaft is rotatably supported in the second positioning hole; and an ice removing assembly. The ice removing assembly comprises: a twisting member, connected with the first shaft, configured to be twisted to drive the ice making tray to twist for ice removal, and provided with a gear; and a press member provided with a gear rack meshed with the gear, and being movable between a first position and a second position in a vertical direction to drive the gear to rotate. When the press member is in the first position, the ice making tray is in an ice making position, and an opening surface of the ice making tray is horizontal; and when the press member is in the second position, the ice making tray is in an ice removing position, the opening surface of the ice making tray is inclined, and the rear end of the ice making tray is abutted against the first limiting protrusion for ice removal.

With the manual ice maker according to embodiments of the present disclosure, by pressing the press member to drive the gear rack which drives the gear to rotate, the ice making tray is twisted to realize ice removal. As the gear rack is meshed with the gear, an assisting force occurs when the press member is pressed. Therefore, the ice can be removed from the ice making tray when a small force is applied by the user (i.e., the press member is pressed with the small force). Moreover, in embodiments of the present disclosure, by providing the first limiting protrusion on the inner surface of the rear wall of the ice making body, the rear end of the ice making tray can be controlled to stop rotating after rotated through a certain angle, while the front end of the ice making tray can continue rotating until the ice making tray is wholly distorted to remove the ice therein.

In one embodiment of the present disclosure, the press member is provided with a second limiting protrusion, and when the press member is in the first position, the second limiting protrusion is abutted against the ice making body to limit a shift of the press member in the vertical direction. Thus, the shift of the press member in the vertical direction can be limited so as to ensure that the press member can return to its correct original position and an appearance of the manual ice maker can be improved.

In one embodiment of the present disclosure, the manual ice maker further comprises an elastic member having one end fixed on the ice making tray and the other end fixed on the ice making body, and the elastic member is configured to make the ice making tray return to the ice making position from the ice removing position. Thus, the user does not need to make the ice making tray return to the original position manually, which is convenient for the user.

According to one embodiment of the present disclosure, the elastic member is a torsion spring.

According to one embodiment of the present disclosure, one end of the torsion spring is fixedly fitted over the second shaft, and the other end of the torsion spring is fixed on the first limiting protrusion.

In one embodiment of the present disclosure, the manual ice maker further comprises a cover, and the cover is disposed on the opening surface of the ice making tray and provided with a funnel shaped water entrance for filling water into the ice making tray. Thus, the cover can prevent water from spilling outside the ice making tray and can prevent dust from entering the interior of the manual ice maker.

In one embodiment of the present disclosure, a first sliding part is formed on an outer surface of the front wall of the ice making body in the vertical direction, a second sliding part is formed on the press member in the vertical direction, and the first sliding part is fitted with the second sliding part to make the press member movable between the first position and the second position. By providing the first sliding part and the second sliding part, it is possible to make the press member move along a predetermined path.

According to one embodiment of the present disclosure, the first sliding part is a sliding track and the second sliding part is a sliding chute.

In one embodiment of the present disclosure, the manual ice maker further comprises an ice removing assembly mask mounted on the front wall of the ice making body, in which a space for holding the ice removing assembly is defined between the ice removing assembly mask and the front wall of the ice making body. By providing the ice removing assembly mask, it is not only able to protect the ice removing assembly but also able to avoid an injury to the user caused by the gear and the gear rack meshed with each other.

In one embodiment of the present disclosure, a step limiting structure is formed on a top surface of the press member, a baffle plate is disposed on a top end of the front wall of the ice making body, and the step limiting structure is cooperated with the baffle plate to define the first position of the press member. Thus, the press member can be further ensured to return to the correct original position.

According to a second aspect of the present disclosure, a refrigerator is provided. The refrigerator comprises: a main body with a freezing chamber disposed therein; and a manual ice maker according to the first aspect of the present disclosure disposed in the freezing chamber.

With the refrigerator according to embodiments of the present disclosure, by completing the ice removing operation within a small front operating space and taking the manual ice maker out of the refrigerator when no ice needs to be made, the freezing space in the refrigerator is saved.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions taken in conjunction with the drawings, in which.

Figure 1:
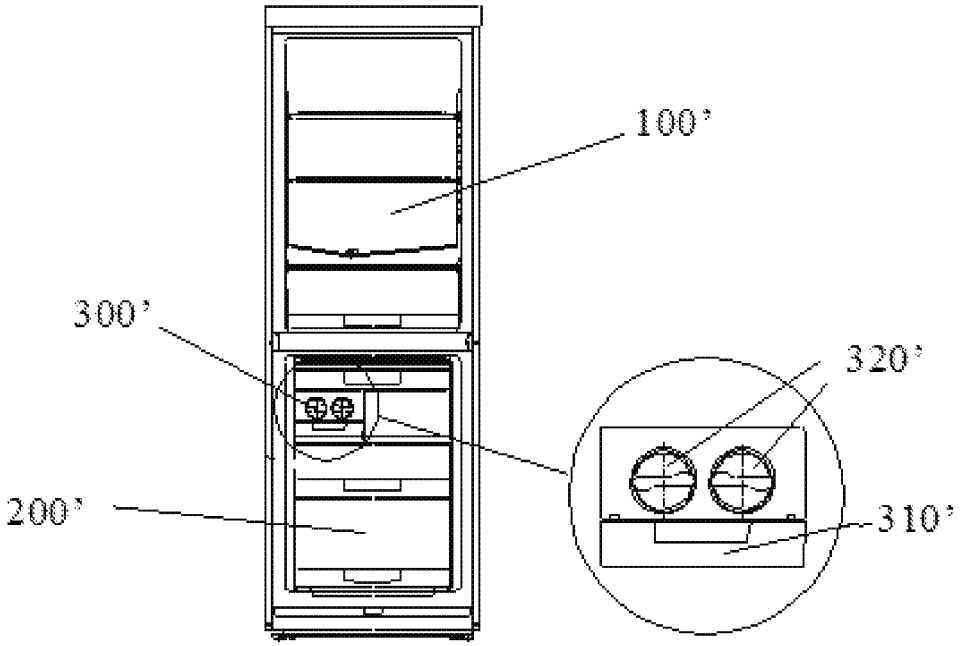
FIG. 1 is a schematic view of a conventional manual ice maker.
Figure 2:
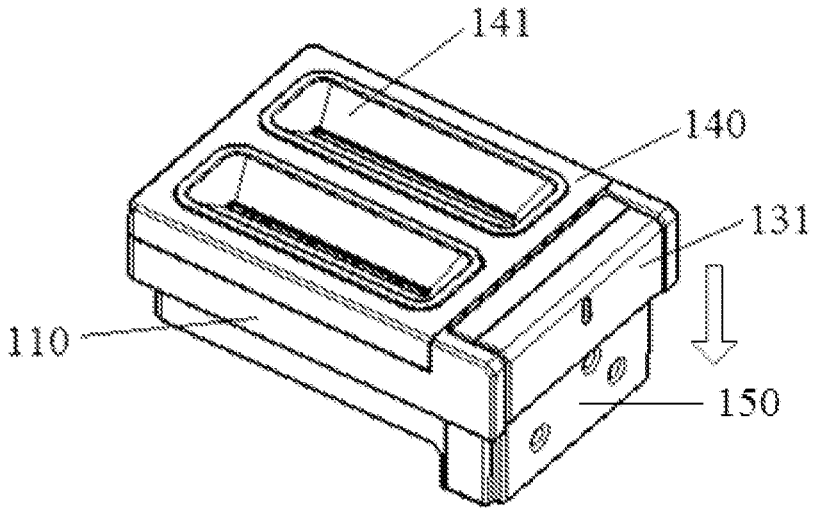
FIG. 2 is a schematic view of a manual ice maker according to an embodiment of the present disclosure.
Figure 3:
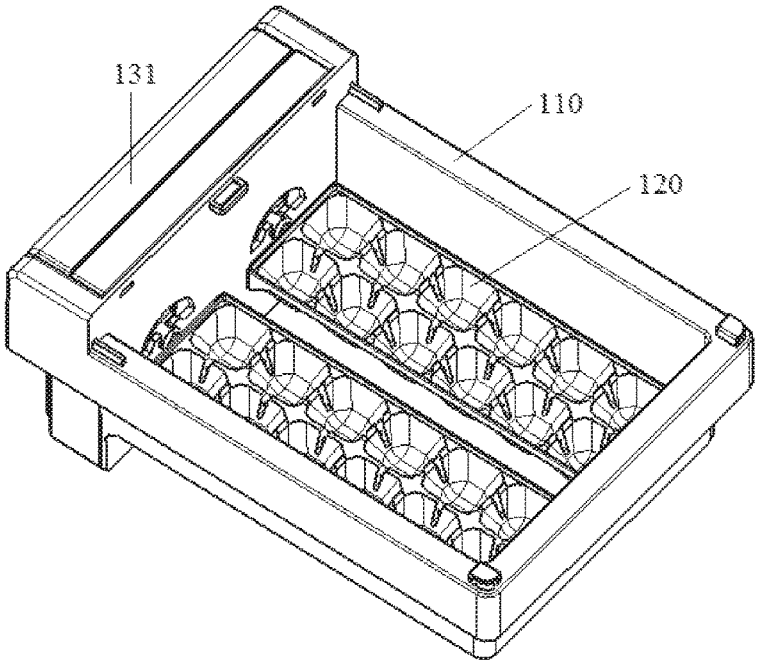
FIG. 3 is a schematic view of a manual ice maker with its cover open according to an embodiment of the present disclosure.
Figure 4:
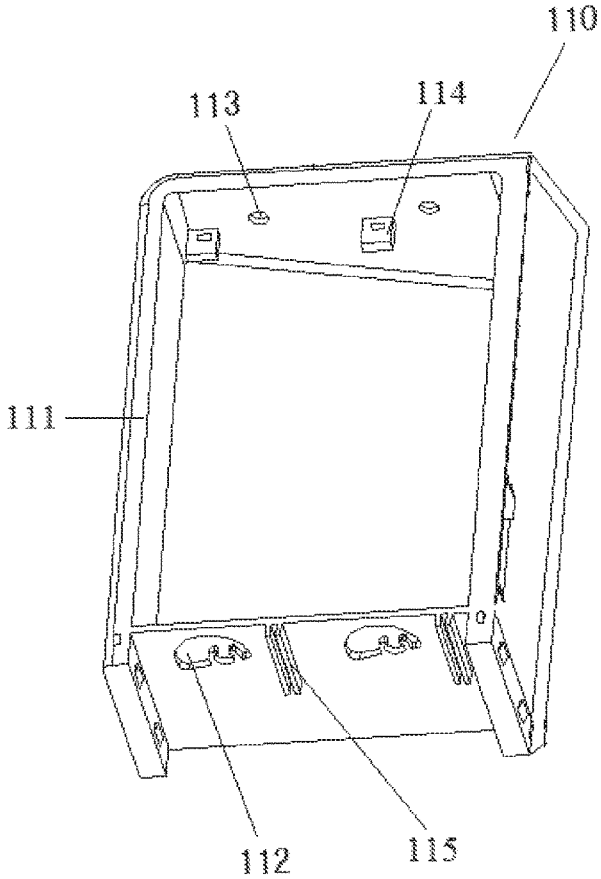
FIG. 4 is a schematic view of an ice making body of a manual ice maker according to an embodiment of the present disclosure.

Parts list:

100 manual ice maker
110 ice making body
111 frame
112 first positioning hole
113 second positioning hole
114 first limiting protrusion
115 sliding track
120 ice making tray
121 first shaft
122 second shaft
123 elastic member
131 press member
132 gear
133 gear rack
134 second limiting protrusion
135 step limiting structure
136 sliding chute
140 cover
141 water entrance
150 ice removing assembly mask
200 refrigerator
210 main body
211 freezing chamber

DETAILED DESCRIPTION

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

It is to be understood that phraseology and terminology used herein with reference to device or element orientation (such as, terms like "longitudinal", "lateral", "up", "down", "front", "rear", "left", "right", "vertical", "horizontal", "top", "bottom", "inside", "outside") are only used to simplify description of the present invention, and do not indicate or imply that the device or element referred to must have or operated in a particular orientation. They cannot be seen as limits to the present disclosure.

Moreover, terms of "first" and "second" are only used for description and cannot be seen as indicating or implying relative importance.

Unless otherwise stipulated and restricted, it is to be explained that terms of "installation", "linkage" and "connection" shall be understood broadly, for example, it could be permanent connection, removable connection or integral connection; it could be direct linkage, indirect linkage or inside linkage within two elements. Those of ordinary skill in the art shall understand the concrete notations of the terms mentioned above according to specific circumstances.

In the following, the manual ice maker according to embodiments of the present disclosure will be described in detail with reference to FIGS. 2-8.

FIGS. 2-8 are schematic views of the manual ice maker and elements thereof according to an embodiment of the present disclosure. As shown in FIGS. 2-8, the manual ice maker 100 according to embodiments of the present disclosure comprises an ice making body 110, an ice making tray 120 and an ice removing assembly.

Specifically, the ice making body 110 is a frame 111 formed with an opening on a top surface thereof. A first positioning hole 112 is provided in a front wall of the ice making body 110, a second positioning hole 113 is provided in a rear wall of the ice making body 110, and a first limiting protrusion 114 is provided on an inner surface of the rear wall of the ice making body 110. It should be noted that the "front wall" refers to a wall close to a user and the "rear wall" refers to a wall far away from the user, i.e., a wall opposite to the front wall.

The ice making tray 120 is provided with a first shaft 121 at a front end thereof and a second shaft 122 at a rear end thereof. The term "front end" refers to an end close to the user and the term "rear end" refers to an end far away from the user. The first shaft 121 is rotatably supported in and extended out of the first positioning hole 112, and the second shaft 122 is rotatably supported in the second positioning hole 113.

The ice removing assembly comprises a pressing member 131 and a gear 132. The gear 132 is mounted on the first shaft 121. The press member 131 is provided with a gear rack 133 meshed with the gear 132. The press member 131 is removable between a first position and a second position in a vertical direction to drive the gear 132 to rotate. When the press member 131 is in the first position, the ice making tray 120 is in an ice making position, and an opening surface of the ice making tray 120 is horizontal; and when the press member 131 is in the second position, the ice making tray 120 is in an ice removing position, the opening surface of the ice making tray 120 is inclined with respect to a horizontal plane, and the rear end of the ice making tray 120 is abutted against the first limiting protrusion 114 for ice removal.

When an ice removing operation is performed, the user presses the press member 131 to make it move from the first position to the second position so as to drive the ice making tray 120 to move from the ice removing position to ice making position, i.e., from a position where the opening surface of the ice making tray 120 is in a horizontal plane to a position where the opening surface of the ice making tray 120 is inclined with respect to the horizontal plane. Specifically, when the press member 131 is pressed, the gear 132 is driven to rotate by the gear rack 133 meshed therewith, and then the first shaft 121 is driven to rotate by the gear 132 to drive the ice making tray 120 to rotate. When the ice making tray 120 rotates through a certain angle (for example, about 110°-115°), the rear end of the ice making tray 120 is abutted against the first limiting protrusion 114 to stop rotating, while the front end of the ice making tray 120 continues rotating (for example, rotating through an angle of about 140°-180°) under the driving of the gear 132 until the ice making tray 120 is wholly distorted to remove the ice therein.

With the manual ice maker 100 according to embodiments of the present disclosure, by pressing the press member 131, the gear 132 is driven to rotate, and then the ice making tray is driven to rotate, thus realizing ice removal. As the ice removing assembly according to embodiments of the present disclosure has simple and compact structure and small footprint, the manual ice maker 100 according to embodiments of the present disclosure can complete the ice removing operation within a small front operating space.

It should be understood that, the ice making body 100 may be a frame 111 of any shape formed with an opening on a top surface thereof, for example, a cuboid frame, a cubic frame, or a drawer-style frame. The specific height of the first limiting protrusion 114 may be designed adaptively according to a size, a mounting position and a shape of the ice making tray 120. The first limiting protrusion 114 may be cuboid, cubic, cylindrical, etc.

In one embodiment of the present disclosure, the press member 131 is provided with a second limiting protrusion 134. When the press member 131 is in the first position, the second limiting protrusion 134 is abutted against the ice making body 110 to limit a shift of the press member 131 in the vertical direction. Thus, the press member 131 is ensured to return to its correct original position and the appearance of the manual ice maker can be improved. Similarly, it should be understood that the second limiting protrusion 134 may also be cuboid, cubic or cylindrical.

In one embodiment of the present disclosure, a step limiting structure 135 is formed on the top surface of the press member 131 and a baffle plate is disposed on the top end of the front wall of the ice making body 110. The step limiting structure 135 is cooperated with the baffle plate to further define the first position of the press member 131.

In one embodiment of the present disclosure, the manual ice maker 100 may further comprise an elastic member 123. One end of the elastic member 123 is fixed on the ice making tray 120 and the other end of the elastic member 123 is fixed on the inner surface of the rear wall of the ice making body 110. When an ice removing operation is performed, the elastic member 123 is compressed or elongated following the rotation of the ice making tray 120. After the ice removing operation is finished, the user does not need to make the ice making tray 120 return to the original position manually, as the ice making tray 120 can automatically return to the original position by the elastic member 123. Thus, the manual ice maker 100 is convenient to use.

Figure 5:
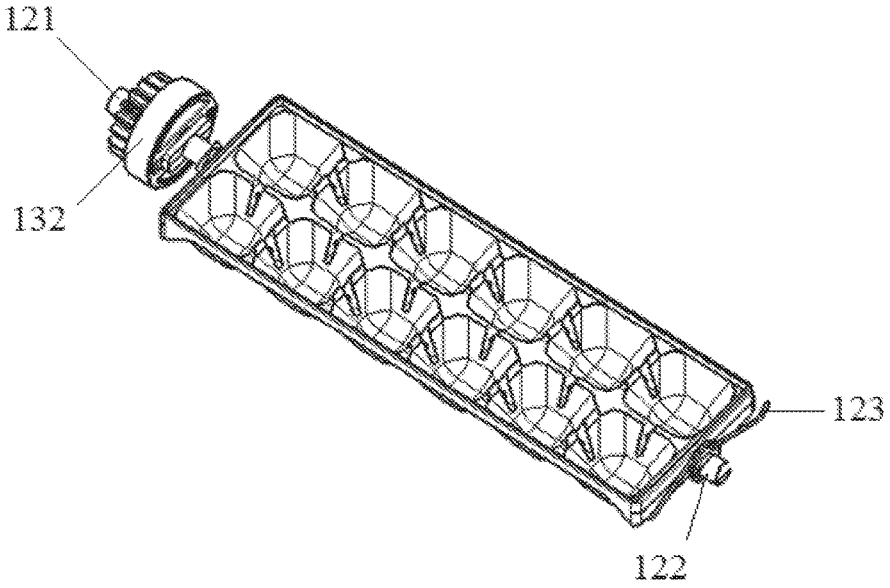
FIG. 5 is a schematic view of an ice making tray of a manual ice maker according to an embodiment of the present disclosure.

In one embodiment of the present disclosure, the elastic member 123 may be a torsion spring. In one specific example of the present disclosure, as shown in FIG. 5, one end of the torsion spring is fitted over the second shaft 122 and the other end of the torsion spring is fixed on the first limiting protrusion 114.

In one embodiment of the present disclosure, the manual ice maker 100 may further comprise a cover 140. The cover 140 is disposed on the opening surface of the ice making tray 120 and provided with a funnel shaped water entrance 141 for filling water into the ice making tray 120. Thus, an accuracy of water filling is ensured without spilling the water outside the ice making tray 120. Meanwhile, the cover 140 can prevent dust from entering the interior of the manual ice maker.

Figure 6:
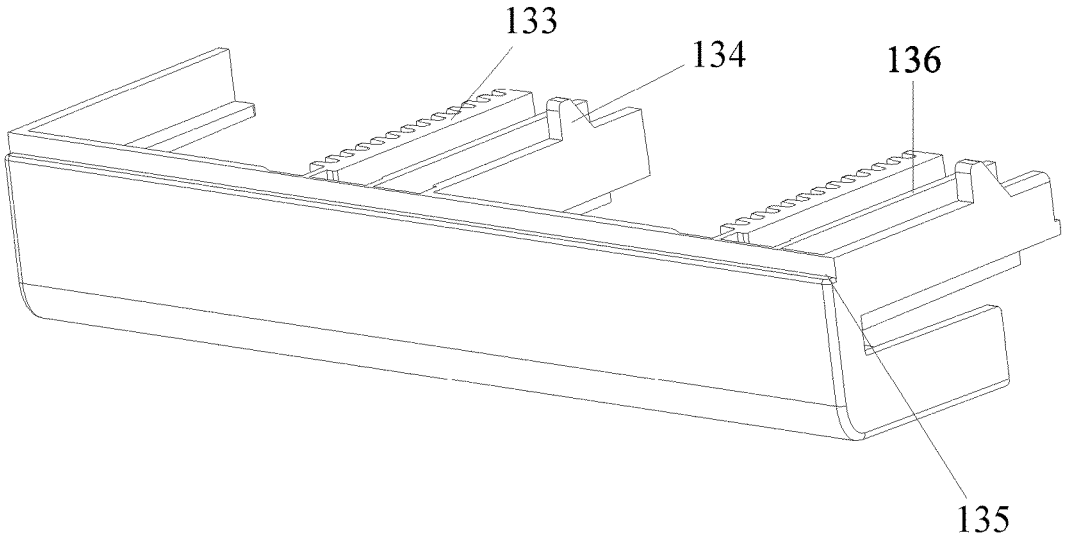
FIG. 6 is a schematic view of a press member of a manual ice maker according to an embodiment of the present disclosure.
Figure 7:
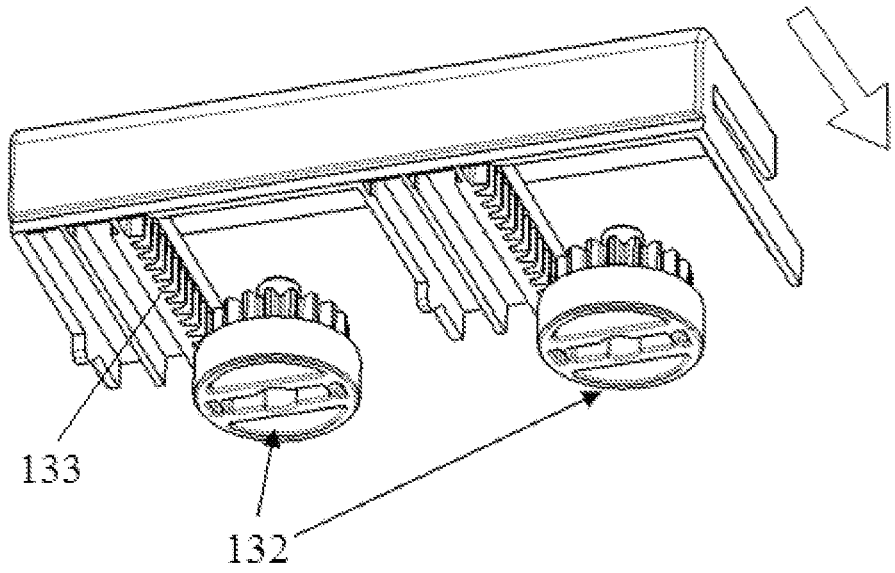
FIG. 7 is a schematic view of a gear meshed with a gear rack according to an embodiment of the present disclosure.
Figure 8:
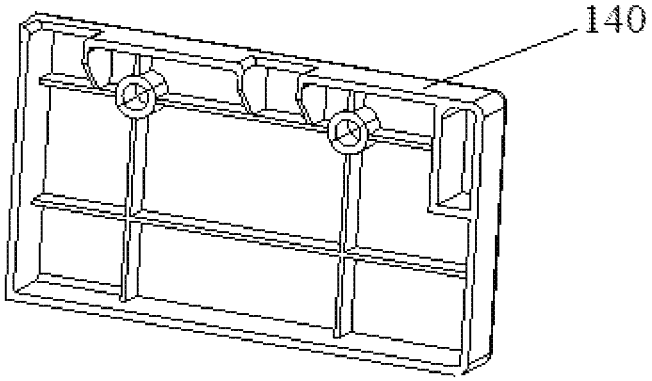
FIG. 8 is a schematic view of an ice removing assembly mask of a manual ice maker according to an embodiment of the present disclosure.

In some embodiments of the present disclosure, the press member 131 is movable between the first position and the second position in a vertical direction (i.e., arrow direction shown in FIG. 1 and FIG. 6). In one embodiment of the present disclosure, a first sliding part is formed on an outer surface of the front wall of the ice making body 110, a second sliding part is formed on the press member 131, and the first sliding part is fitted with the second sliding part to make the press member 131 movable between the first position and the second position in the vertical direction. By providing the first sliding part and the second sliding part, the movement of the press member 131 can be more stable.

The first sliding part may be formed on the outer surface of the front wall of the ice making body 110 in the vertical direction or in an inclined direction. The second sliding part may be formed on the press member 131 in a direction parallel to the gear rack 133.

In one embodiment of the present disclosure, the first sliding part may be a sliding track 115 formed on the outer surface of the front wall of the ice making body 110 in the vertical direction, and the second sliding part may be a sliding chute 136 parallel to the gear rack 133. In another embodiment of the present disclosure, the first sliding part may be the sliding chute 136 formed in the outer surface of the front wall of the ice making body 110 in the vertical direction, and the second sliding part may be the sliding track 115 parallel to the gear rack 133.

In some embodiments of the present disclosure, the manual ice maker 100 may further comprise an ice removing assembly mask 150. The ice removing assembly mask 150 may be mounted on the front wall of the ice making body 110. A space for holding the ice removing assembly may be defined between the ice removing assembly mask 150 and the front wall of the ice making body 110. By providing the ice removing assembly mask 150, it is not only able to protect the ice removing assembly (i.e., the press member 131 and the gear 132), but also able to avoid an accidental injury to the user caused by the gear 132 and the gear rack 133 meshed with each other during the ice removing operation.

There are no particular limitations on the mounting way of the ice removing assembly mask 150. For example, in one embodiment, threaded holes may be disposed in the front wall of the ice making body 110 and the ice removing assembly mask 150, and the ice removing assembly mask 150 may be mounted on the front wall of the ice making body 110 by using a bolt assembly. In another embodiment, a protrusion may be disposed on the front wall of the ice making body 110, a groove may be disposed in the ice removing assembly mask 150, and then the ice removing assembly mask 150 may be mounted on the ice making body 110 by the cooperation of the protrusion and the groove. The ice removing assembly mask 150 may be provided with a gap to avoid hitting the gear rack 133.

It should be noted that, the manual ice maker 100 according to embodiments of the present disclosure may have one or more ice making trays 120, as long as corresponding numbers of first positioning holes 112 and second positioning holes 113 are provided in the front wall and rear wall of the ice making body 110 respectively for mounting the plurality of ice making trays 120, the first shaft 121 of each ice making tray 120 is provided with the gear 132, and a corresponding number of gear racks 133 are disposed on one press member 131 for driving the gears 132 to rotate. Those skilled in the art shall understand that corresponding numbers of first limiting protrusions 114, elastic members 123, sliding tracks 115, and sliding chutes 136 may also be provided. Thus, by pressing the press member 131 once, the plurality of ice making trays 120 can be twisted and overturned to remove ice simultaneously.

Figure 9:
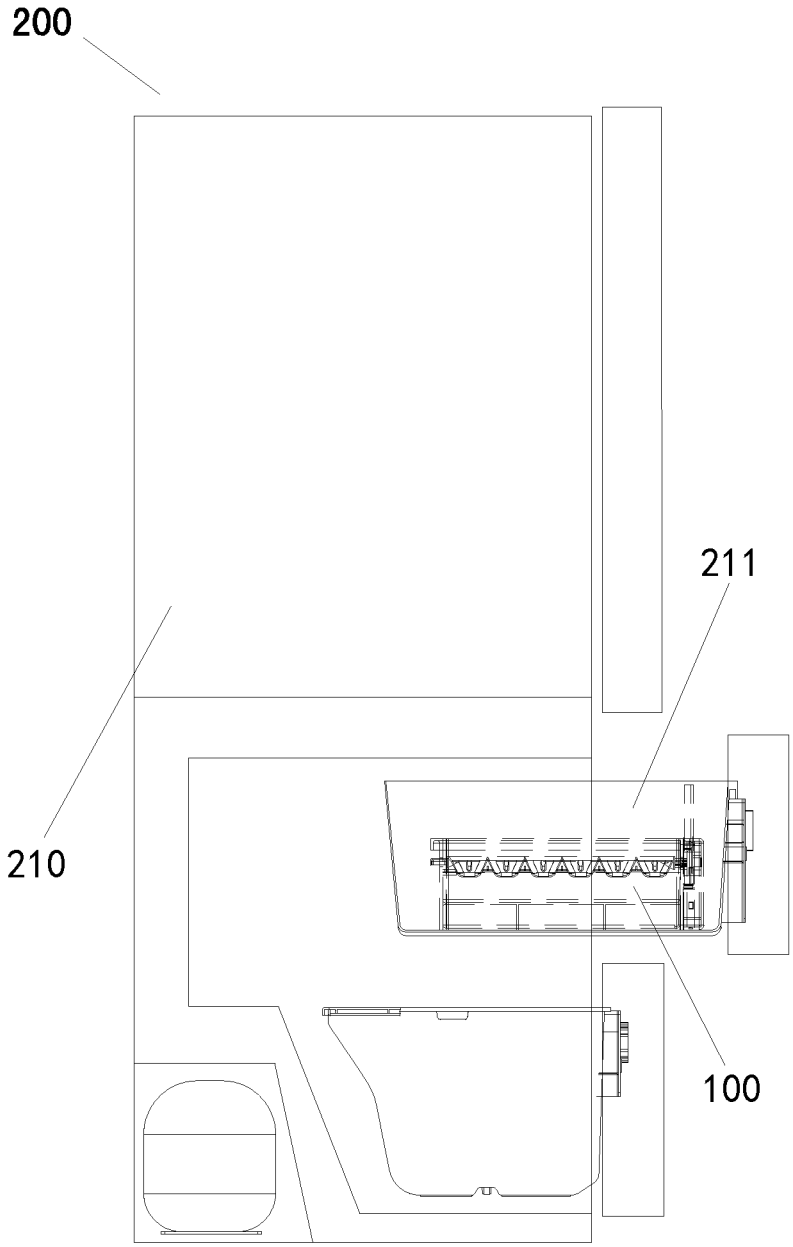
FIG. 9 is a schematic view of a refrigerator according to an embodiment of the present disclosure.

FIG. 9 is a schematic view of a refrigerator according to an embodiment of the present disclosure. As shown in FIG. 9, the refrigerator 200 comprises a main body 210 and the manual ice maker described above. The main body 210 is provided with a freezing chamber 211 therein and the manual ice maker is disposed in the freezing chamber 211.

With the refrigerator 200 according to embodiments of the present disclosure, by completing the ice removing operation within a small front operating space and taking the manual ice maker out of the refrigerator when no ice needs to be made, the freezing space in the refrigerator is saved.

Reference throughout this specification to "an embodiment", "some embodiments", "one schematic embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. The changes, alternatives, and modifications all fall into the scope of the claims and their equivalents.

What is claimed is:

1. A manual ice maker, comprising:

an ice making body being a frame formed with an opening, and provided with a first positioning hole in a front wall of the ice making body, a second positioning hole in a rear wall of the ice making body and a first limiting protrusion on an inner surface of the rear wall of the ice making body;

an ice making tray provided with a first shaft at a front end of the ice making tray and a second shaft at a rear end of the ice making tray, wherein the first shaft is rotatably supported in and extended out of the first positioning hole, and the second shaft is rotatably supported in the second positioning hole; and an ice removing assembly, comprising:

a twisting member, connected with the first shaft, capable of being twisted to drive the ice making tray to twist for ice removal by twisting the first shaft attached to the ice making tray, and provided with a gear; and a press member disposed with a gear rack on the press member meshed with the gear, and being movable between a first position and a second position in a vertical direction to drive the gear to rotate, a first sliding part being formed on an outer surface of the front wall of the ice making body in the vertical direction, a second sliding part being formed on the press member in the vertical direction parallel with the gear rack, and the first sliding part being fitted with the second sliding part to make the press member movable between the first position and the second position, the first sliding part being a sliding track and the second sliding part being a sliding chute, the sliding chute being parallel with the gear rack, a side wall of the sliding chute and the gear rack protruding downward from an inner side of the press member and being substantially vertical to the press member, the press member being provided with a second limiting protrusion, the second limiting protrusion protruding from and formed on an inner surface of the side wall of the sliding chute, a step limiting structure being formed on a top surface of the press member and being formed to have an L shape, a baffle plate being disposed on a top end of the front wall of the ice making body, and the step limiting structure cooperating with the baffle plate to define the first position of the press member, wherein when the press member is in the first position, the ice making tray is in an ice making position, and an opening surface of the ice making tray is horizontal; and when the press member is in the second position, the ice making tray is in an ice removing position, the opening surface of the ice making tray is inclined, wherein when the ice making tray rotates through a certain angle, the rear end of the ice making tray is abutted against the first limiting protrusion to stop rotating, while the front end of the ice making tray continues rotating under the driving of the gear until the ice making tray is wholly distorted to remove ice in the ice making tray.

2. The manual ice maker according to claim 1, wherein when the press member is in the first position, the second limiting protrusion is abutted against the ice making body to limit a shift of the press member in the vertical direction.

3. The manual ice maker according to claim 1, further comprising:

an elastic member having one end fixed on the ice making tray and the other end fixed on the ice making body, and configured to make the ice making tray return to the ice making position from the ice removing position.

4. The manual ice maker according to claim 3, wherein the elastic member is a torsion spring.

5. The manual ice maker according to claim 4, wherein one end of the torsion spring is fixedly fitted over the second shaft, and an other end of the torsion spring is fixed on the first limiting protrusion.

6. The manual ice maker according to claim 1, further comprising:

a cover, disposed on the opening surface of the ice making tray and provided with a funnel shaped water entrance for filling water into the ice making tray.

7. The manual ice maker according to claim 1, further comprising:

an ice removing assembly mask mounted on the front wall of the ice making body, wherein a space for holding the ice removing assembly is defined between the ice removing assembly mask and the front wall of the ice making body.

8. A refrigerator, comprising:

a main body with a freezing chamber disposed therein; and a manual ice maker disposed in the freezing chamber, wherein the manual ice maker comprises:

an ice making body being a frame formed with an opening, and provided with a first positioning hole in a front wall of the ice making body, a second positioning hole in a rear wall of the ice making body and a first limiting protrusion on an inner surface of the rear wall of the ice making body;

an ice making tray provided with a first shaft at a front end of the ice making tray and a second shaft at a rear end of the ice making tray, wherein the first shaft is rotatably supported in and extended out of the first positioning hole, and the second shaft is rotatably supported in the second positioning hole; and an ice removing assembly, comprising:

a twisting member, connected with the first shaft, capable of being twisted to drive the ice making tray to twist for ice removal by twisting the first shaft attached to the ice making tray, and provided with a gear; and a press member disposed with a gear rack on the press member meshed with the gear, and being movable between a first position and a second position in a vertical direction to drive the gear to rotate, a first sliding part being formed on an outer surface of the front wall of the ice making body in the vertical direction, a second sliding part being formed on the press member in the vertical direction parallel with the gear rack, and the first sliding part being fitted with the second sliding part to make the press member movable between the first position and the second position, the first sliding part being a sliding track and the second sliding part being a sliding chute, the sliding chute being parallel with the gear rack, a side wall of the sliding chute and the gear rack protruding downward from an inner side of the press member and being substantially vertical to the press member, the press member being provided with a second limiting protrusion, the second limiting protrusion protruding from and formed on an inner surface of the side wall of the sliding chute, a step limiting structure being formed on a top surface of the press member and being formed to have an L shape, a baffle plate being disposed on a top end of the front wall of the ice making body, and the step limiting structure cooperating with the baffle plate to define the first position of the press member, when the press member is in the first position, the ice making tray is in an ice making position, and an opening surface of the ice making tray is horizontal; and when the press member is in the second position, the ice making tray is in an ice removing position, the opening surface of the ice making tray is inclined, wherein when the ice making tray rotates through a certain angle, the rear end of the ice making tray is abutted against the first limiting protrusion to stop rotating, while the front end of the ice making tray continues rotating under the driving of the gear until the ice making tray is wholly distorted to remove ice in the ice making tray.

9. The refrigerator according to claim 8, wherein when the press member is in the first position, the second limiting protrusion is abutted against the ice making body to limit a shift of the press member in the vertical direction.

10. The refrigerator according to claim 8, wherein the manual ice maker further comprises:

an elastic member having one end fixed on the ice making tray and the other end fixed on the ice making body, and configured to make the ice making tray return to the ice making position from the ice removing position.

11. The refrigerator according to claim 10, wherein the elastic member is a torsion spring.

12. The refrigerator according to claim 11, wherein one end of the torsion spring is fixedly fitted over the second shaft, and the other end of the torsion spring is fixed on the first limiting protrusion.

13. The refrigerator according to claim 8, wherein the manual ice maker further comprises:

a cover, disposed on the opening surface of the ice making tray and provided with a funnel shaped water entrance for filling water into the ice making tray.

14. The refrigerator according to claim 8, wherein the manual ice maker further comprises:

an ice removing assembly mask mounted on the front wall of the ice making body, wherein a space for holding the ice removing assembly is defined between the ice removing assembly mask and the front wall of the ice making body.

* * * * *